US007222735B2

(12) United States Patent
Greubel

(10) Patent No.: US 7,222,735 B2
(45) Date of Patent: May 29, 2007

(54) RAIL PACKAGING

(75) Inventor: Roland Greubel, Ramsthal (DE)

(73) Assignee: Rexroth Star GmbH, Schweinfurt (DE)

( * ) Notice: Subject to any disclaimer, the term of this patent is extended or adjusted under 35 U.S.C. 154(b) by 386 days.

(21) Appl. No.: 10/790,398

(22) Filed: Mar. 1, 2004

(65) Prior Publication Data

US 2004/0173495 A1 Sep. 9, 2004

(30) Foreign Application Priority Data

Mar. 6, 2003 (DE) ..... 103 09 848

(51) Int. Cl.

| | |
|---|---|
| ***B65D 85/20*** | (2006.01) |
| ***B65D 81/24*** | (2006.01) |
| ***B65D 69/00*** | (2006.01) |
| ***E01B 23/00*** | (2006.01) |

(52) U.S. Cl. ..... 206/493; 206/231; 206/205; 238/10 R

(58) Field of Classification Search ..... 206/486, 206/204–207, 231, 443, 493, 477–483, 318, 206/764, 765, 775, 778, 321, 347, 338; 81/13; 238/10 R, 122–150, 1

See application file for complete search history.

(56) References Cited

U.S. PATENT DOCUMENTS

| | | | | |
|---|---|---|---|---|
| 572,061 | A * | 11/1896 | Newton | 206/338 |
| 1,330,864 | A * | 2/1920 | Hamilton | 206/231 |
| 2,828,857 | A | 4/1958 | MacKay | |
| 2,998,132 | A * | 8/1961 | Wilson | 206/321 |
| 3,444,991 | A | 5/1969 | Raybois | |
| 4,291,803 | A | 9/1981 | Perales | |
| 4,821,877 | A * | 4/1989 | Aab et al. | 206/338 |
| 4,976,374 | A * | 12/1990 | Macaluso | 229/122.26 |
| 5,437,368 | A * | 8/1995 | Mikels | 206/341 |
| 5,966,779 | A * | 10/1999 | Salice | 16/382 |
| 6,705,464 | B1 * | 3/2004 | Yang | 206/345 |
| 6,851,602 | B2 * | 2/2005 | Gosis et al. | 229/125.22 |
| 6,915,946 | B2 * | 7/2005 | Gosis et al. | 229/101 |

FOREIGN PATENT DOCUMENTS

| | | |
|---|---|---|
| DE | 72 16 134 | 4/1972 |
| DE | 91 15 929.6 | 4/1992 |
| DE | 297 00 046 U1 | 5/1997 |

* cited by examiner

*Primary Examiner*—Mickey Yu
*Assistant Examiner*—J. Gregory Pickett
(74) *Attorney, Agent, or Firm*—Michael J. Striker

(57) ABSTRACT

A packaging (10) for a component (12) can be attached by means of at least one attachment element (14) to a mounting surface of a superordinate component, whereby the component (12) has an upper surface (12*a*), a bottom surface (12*b*) and at least one mounting (12*c*) for the at least one attachment element (14) continuous from the upper surface (12*a*) to the bottom surface (12*b*). The packaging (10) is at least partially substantially rigidly formed and the at least one attachment element (14) inserted in the at least one mounting (12*c*) is maintained in a position in a positive-locking (form-locking) manner, in which it does not project over the bottom surface (12*b*) of the component. For packaging of the component (12) into the packaging (10), advantageously an auxiliary element is used.

12 Claims, 5 Drawing Sheets

RAIL PACKAGING

BACKGROUND OF THE INVENTION

CROSS-REFERENCE

The invention described and claimed hereinbelow is also described in DE 103 09 858.8, filed on Mar. 6, 2003. This German Patent Application, whose subject matter is incorporated here by reference, provides the basis for a claim of priority of invention under 35 U.S.C. 119 (a)–(d).

The invention relates to a packaging for a component, which can be attached by means of at least one attachment element to a mounting surface of a superordinate unit, whereby the component has an upper surface, a bottom surface, and at least one mounting for the at least one attachment element continuing from the upper surface to the bottom surface. The invention also relates to a method for packaging of such a component.

Although the invention will be described and explained predominately with reference to the packaging of a profiled rail or bar, in particular, a guide rail of a linear guide device, already at this point, it should be noted that the invention can be used also to advantage with other types of attachment elements, in particular, screws, on a mounting surface of components to be attached to a superordinate unit. When the word "attachment element", as used above and in the subsequent description, is employed also in the plural, the case of a component which can be attached merely by means of a single attachment element to the mounting surface of the superordinate unit is not to be excluded.

Currently, it is common to attach the attachment elements, in particular, screws, which are needed to attach the component to the mounting surface of the superordinate unit, numbered in a single packaging, for example, a plastic bag, and the component in a shrink-wrap, plastic-film. Thus, before assembly, not only the component must be unwrapped, but also the attachment screws must be unwrapped, which then must be inserted in the mountings of the component provided for the screws. This is laborious and requires a relatively large amount of work time.

In contrast, it is an object of the present invention to provide a packaging of the above-described type, which enables a reduction in the work time required for the attachment of the component to the mounting surface of the superordinate unit.

This object is solved by the present invention with a packaging of the above-described type, which is formed at least partially substantially rigidly and holds the at least one attachment element inserted in the at least one mounting in a form-locking (or positive-locking) manner in a position, in which it does not project over the bottom surface of the component. With the use of the packaging of the present invention, separate unwrapping of attachment elements and their insertion into the mountings of the component provided for them is eliminated, since these are already located ready for assembly in the mountings provided for them. In addition, the at least one attachment element cannot hinder the attachment of the component onto the mounting surface of the superordinate component, since it does not project over the bottom surface of the component.

In order to enable the at least one attachment element to be held in a form-locking or positive-locking manner in a position in which it does not project over the bottom surface of the component, the packaging, for example, can have at least one locking bar, which engages under a head of an associated attachment element.

In order to enable the head of the attachment element to be held in a form-locking or positive-locking manner between the locking bar and an upper wall of the packaging, it is proposed that the locking bar either is formed as a substantially planar shoulder of a wide wall of the packaging or as an essentially L-shaped shoulder of the upper wall of the packaging.

In a further embodiment of the invention, it is proposed that a main body of the packaging is composed of at least two parts, namely, a cover part and a floor part, whereby the cover part preferably covers the upper surface and at least one part of the side surfaces of the component, while the floor part preferably covers the bottom surface and at least a part of the side surfaces of the component.

In this manner, the locking bar can be disposed advantageously either on the cover part or on an element separate from the remaining packaging, in particular, the cover part, preferably in the form of strips, for example, made of cardboard. In both of these cases, then, namely for preparation of the attachment of the component to the mounting surface of the superordinate unit, first the floor part can be detached from the component, without the at least one attachment element falling completely into mounting of the component and projecting over the bottom surface of the component. This makes possible, for one, a trouble-free cleaning of the bottom surface of the component before assembly, and for another, makes possible the unhindered attachment onto the mounting surface of the superordinate unit. After the attachment of the component onto the mounting surface, the cover part can be removed from the component. In the former case, the attachment elements fall into their mountings in the course of this processing step, while in the latter situation, the cardboard strips or another element must be removed. Subsequently, the attachment elements can be connected by means of a suitable tool with the mounting surface of the superordinate unit. Attachment screws can be screwed into the attachment bores of the mounting surface by means of a motorized screw driver.

In order to enable protection of the component from damage, for example, by inadvertent introduction of the component by the assembly personnel, the cover part of the packaging can be attached after the attachment of the component onto the superordinate unit as a protective cap again onto the component.

In order also to accomplish mounting the component with the bottom surface not showing, for example, an over-head assembly of the component, the cover part can have a hole corresponding to the position of the at least one attachment element. By means of this hole, a mounting tool can be brought into engagement with the attachment element, while this is held in a form-locking manner, as before, by the cover part. In order to prevent penetration of dirt into the packaging, the hole can be covered before assembly, for example, by means of an adhesive film, which is pierced in the course of the assembly by the assembly tool.

In order to avoid destruction of the locking bar in the course of this assembly, in a further modification of this embodiment, it is proposed that the at least one locking bar is resiliently disposed on the cover part. In this regard, a section of the locking pin engaging under a head of the attachment element can be arranged spaced from the upper surface of the component and a section of the locking bar connecting this section with the cover part, for example, by selective material weakening, can be formed to be resilient and elastic.

In order to make possible an over-head assembly, in which the packaging, in particular, its cover part, is not necessarily destroyed, additional, or alternatively, a mounting can be formed on a locking bar-free longitudinal end of the cover part which is opened in the longitudinal direction of the cover part, whose defining edge holds the attachment element over an edge region of its head in a form-locking ("positive-locking") manner, while simultaneously making possible access to the attachment element by means of a mounting tool.

To make possible a stable attachment of the packaging on the component, in a further embodiment of the invention, it is proposed that the cover part and/or the floor part has at least one stabilizing bar, which is supported on a side surface of the component.

To provide a stabile unit with the two-part structure of the main body of the packaging, it is proposed further that the cover part and the floor part are locked with one another, whereby, if desired, this locking is secured by means of adhesive strips.

It should also be noted that the cover part and/or the floor part can be formed as an extruded plastic profile part.

In order to adapt the length of the packaging in a simple manner to the length of the component to be packaged, for example, the length of the guide rail to be packaged for a linear guide unit, it is proposed in a further embodiment that the cover part and/or the floor part are formed from a plurality of preferably identical components, which can be made as injection molded parts, for example. In this manner, the costs for manufacture and storage of the packaging of the present invention can be lowered.

The packaging further can include at least one end cap, which covers an associated front surface of the component. Also, this end cap can be made, for example, as an injection molded part.

With the packaging of components that are in danger of corrosion, it is finally advantageous to provide means for protecting the component from corrosion. This can take place, for example, by application of a corrosion-protection paper or by manufacturing the packaging from a suitable out-gassed plastic.

According to a further consideration, the invention also relates to a method for packaging a component using the previously described packaging of the present invention, including the following steps:

attaching the component to an auxiliary element, which has at least one projection at a position corresponding to a position of the at least one attachment element;

inserting the at least one attachment element into the mounting of the component provided therefore;

mounting the cover part;

removing the component from the auxiliary element; and mounting the floor part.

By using the auxiliary element of the present invention, the attachment elements inserted into the mountings of the component can be held trouble-free in a position, which makes possible an effortless mounting of the cover part, for example, by a lateral displacement on the component.

DETAILED DESCRIPTION OF THE PREFERRED EMBODIMENTS

Figure 1:
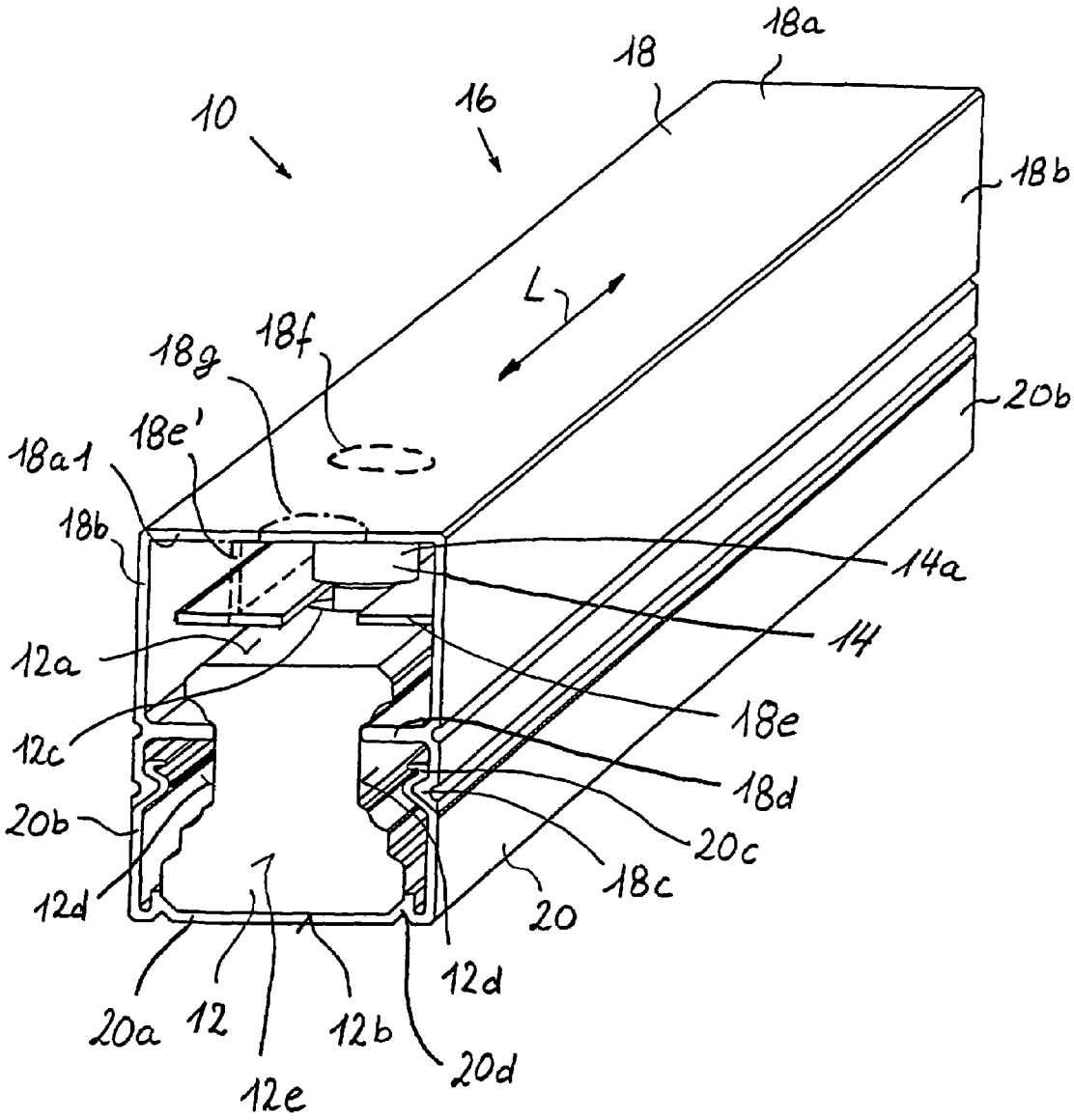
FIG. 1 is a perspective view of a guide rail of a linear guide unit accommodated in the packaging of the present invention.

In FIG. 1, the packaging of the present invention is designated generally with reference numeral 10.

The packaging serves for packaging a profiled rail 12, for example, a guide rail of a linear guide unit, which is to be attached via attachment means 14 to a superordinate unit (not shown). The profiled rail 12 has an upper surface 12*a* and a bottom surface 12*b*. In addition, a plurality of through holes 12*c* are formed in the profiled rail 12, which penetrate through the profiled rail 12 from the upper surface 12*a* to the bottom surface 12*b*. These through holes 12*c* serve for receiving a corresponding multitude of attachment screws 14, which serve to attach the profiled rail 12 to the superordinate unit.

In the embodiment shown, a main body 16 of the packaging 10 is formed in two parts with a cover part 18 and a floor part 20. The cover part 18 covers the upper surface 12*a* of the profiled rail 12 with an upper wall 18*a*, as well as the side or lateral surfaces 12*d* of the profiled rail 12 with side walls 18*b*. The floor part 20 covers the bottom surface 12*d* of the profiled rail 12 with a floor wall 20*a* and covers the side surfaces 12*d* of the profiled rail 12 with side walls 20*b*. Via a locking projection 18*c* of the cover part 18 and a correspondingly formed locking depression 20*c* of the floor part 20, the cover part 18 and the floor part can be locked onto one another and thereby are connected firmly.

For further stabilization of the main body 16 of the packaging 10, the cover part 18 includes shoulders 18*d* protruding to the profiled rail 12, with which the cover part 18 is supported on the side surfaces 12*d* of the profiled rail 12.

In addition, between these stabilizing shoulders 18*d* and the upper wall 18*a* of the cover part 18, inwardly spaced projections 18*e* are provided, which serve as a locking bar for the attachment screws 14. The locking bar 18*e* engages under the heads 14*a* of the attachment screws 14, so that the attachment screws 14 cannot fall completely into the mountings 12*c* of the profiled rail 12. In this manner, the attachment screws do not project over the bottom surface 12*b* of the profiled rail 12 in this packaging position.

Although the locking bars 18*e* are formed in the embodiment according to FIG. 1 as shoulders, which extend out from side walls 18*b* of the cover part 18, it is also basically contemplated that L-shaped locking bars 18*e*' can be used, which extend from the upper wall 18*a* of the cover part 18. In this case, the free leg of the L-shape merely engages under the heads 14*a* of the attachment screws 14. Essentially, however, it is also contemplated that the locking bar is formed on an element formed separately from the remaining packaging, for example, a cardboard strip.

It should be noted also that the locking bars 18*e* are formed to be continuous for facilitation of the manufacture of the cover part 18, for example, as an extruded plastic profile, in the longitudinal direction L of the cover part 18. Basically, however, it is also contemplated that for each attachment screw 14, one or more separately formed locking bar can be provided.

With the mounting of the profiled rail 12, the following process can be performed:

First, the floor part 20 is pulled out from the cover part 18 in the longitudinal direction L or removed by releasing the locking 18*c*/20*c* from below. Subsequently, the bottom surface 12*b* of the profiled rail 12 can be cleaned and attached with this bottom surface 12*b* onto the mounting surface of the superordinate unit. The attachment screws 14 still held by the cover part 18 cannot impede this process, since they do not project over the bottom surface 12*b* of the profiled rail 12.

In a further step, the cover part 18 is removed now from the profiled rail 12, for example, pulled off in the longitudinal direction L or removed by bending up. In doing so, the attachment screws 14 fall fully into the mountings 12*c* and can be screwed into the associated threaded bores of the mounting surface by means of a mounting tool, for example, a motorized screw driver. Subsequently, the cover part 18 can be attached for protection of the profiled rail 12, for example, before introduction of the profiled rail 12 by assembly personnel, again as protective caps.

In order to make possible mounting of the profiled rail 12 also with a profiled bar not having a bottom surface 12*b*, for example with an over-head mounting of the profiled rail 12, the cover part 18*a* can have perforations at a position corresponding to the positions of the attachment screws 14, of which only one is shown in dashed lines in FIG. 1 for the sake of simplicity. After removal of the floor part 20, the mounting tool can be brought into engagement through these perforations 18*f* with the attachment screws 14. In order to prevent the holding bars 18*e* from being destroyed upon screwing-in of the attachment screws 14 into the threaded bores of the mounting surface, L-shaped holding bars 18*e*' can be used, which, with the L-leg connected with the cover part 18, is resiliently formed, so that the locking bar 18*e*' can draw aside the screwhead 14*a* moved into the mountings 12*c*.

It should be noted also that the perforations 18*f* can be covered in the packaged state of the profiled rail 12, for example, by means of a film, in order to prevent penetration of dirt into the packaging 10.

Also, in order to prevent destruction of the locking bar 18*e* with an over-head mounting and therewith, in this case, also to make possible reuse of the packaging 10, the locking bar, as shown in FIG. 1, can be formed to be somewhat shorter than the side walls 18*d* of the cover part 18. In addition, in this case, on the longitudinal edge 18*a*1 of the upper wall 18*a*, a mounting 18*g*, shown in FIG. 1 as a dot-and-dash line, is provided. Upon mounting, the cover part 18 is pulled off in the longitudinal direction from the profiled rail 12, until its longitudinal edge 18*a*1 comes into the region of an attachment screw 14. In this state, the circumferential edge of the mounting 18*g* holds the head 14*a* of the attachment screw 14, while at the same time, this is located in a locking bar-free region of the cover part 18. In any event, the mounting 18*g* allows the attachment screw 14 to be screwed into the mounting surface by means of a mounting tool. Subsequently, the cover part 18 is pulled back until it reaches the further attachment screws 14.

It should be noted also that the floor wall 20*a* of the floor part 20 is formed with inwardly extending projections 20*d*, which prevent a lateral shifting of the profiled rail 12 into the floor part 20.

Figure 5:
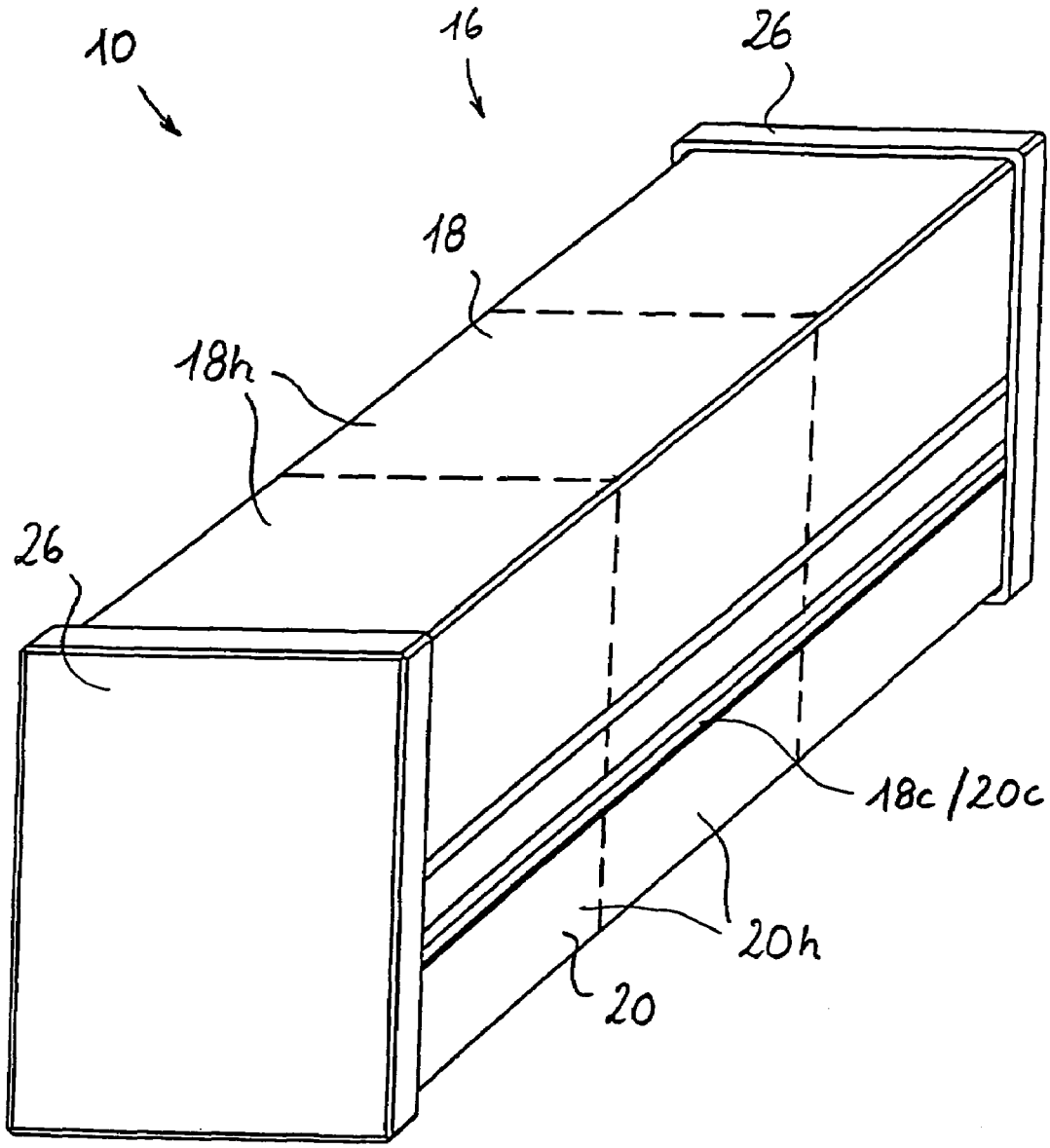

It should be noted further that the cover part 18 and the floor part 20, as shown in FIG. 5 by dashed lines, can be composed respectively of a plurality of identically formed components 18*h*, 20*h*, which, for example, can be made as injection molded parts. In this manner, the length of the packaging can be adapted in a simple manner to the length of the component to be packaged, for example, the length of the guide rail to be packaged for a linear guide unit. In addition, the costs for manufacturing and storage of the packaging of the present invention are minimized.

Next, the procedure upon packaging of the profiled rail 12 in the packaging 10 of the present invention will be described in greater detail with reference to FIGS. 2–5.

Figure 2:
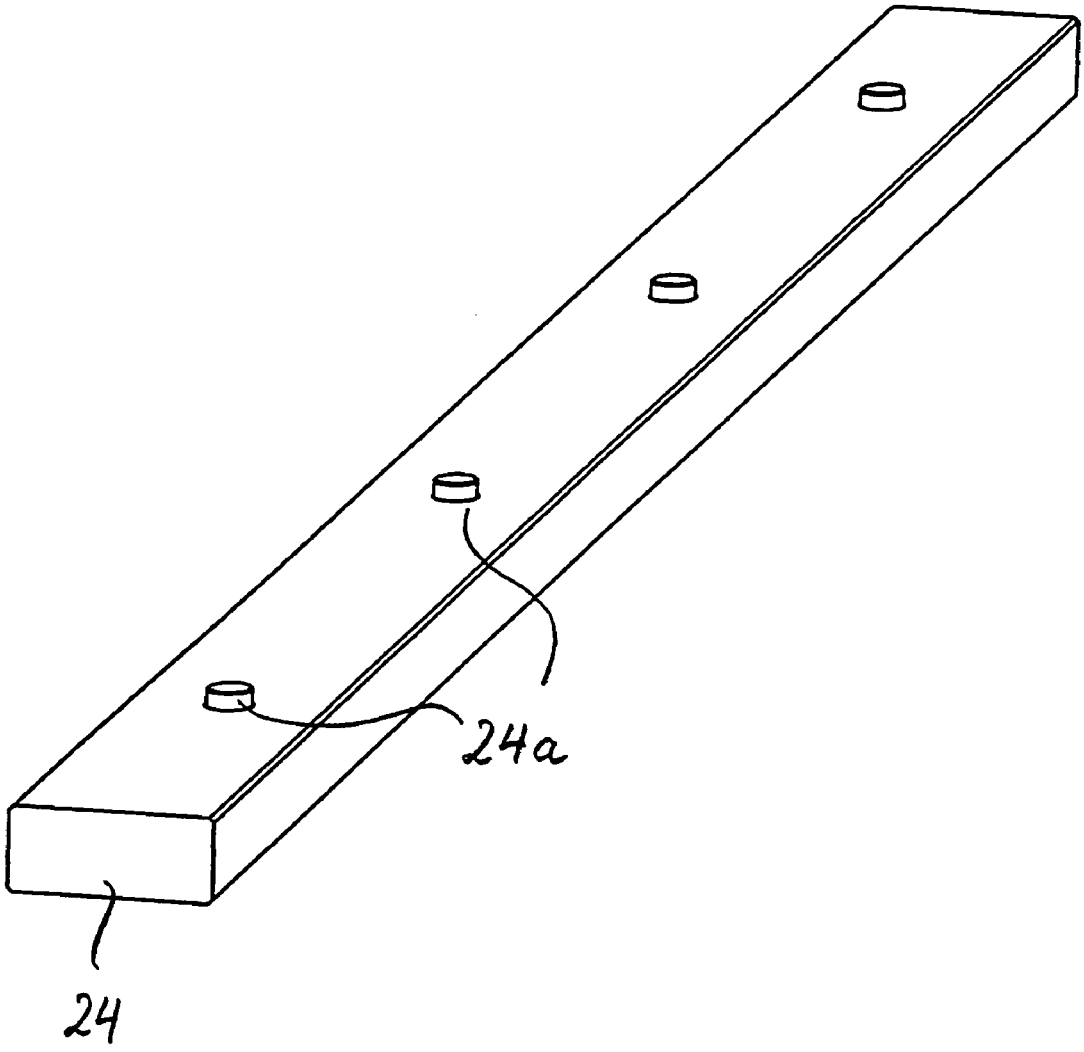
FIGS. 2–5 are perspective views for explanation of the method according to the present invention for packaging this profile drail using the packaging of the present invention.
Figure 3:
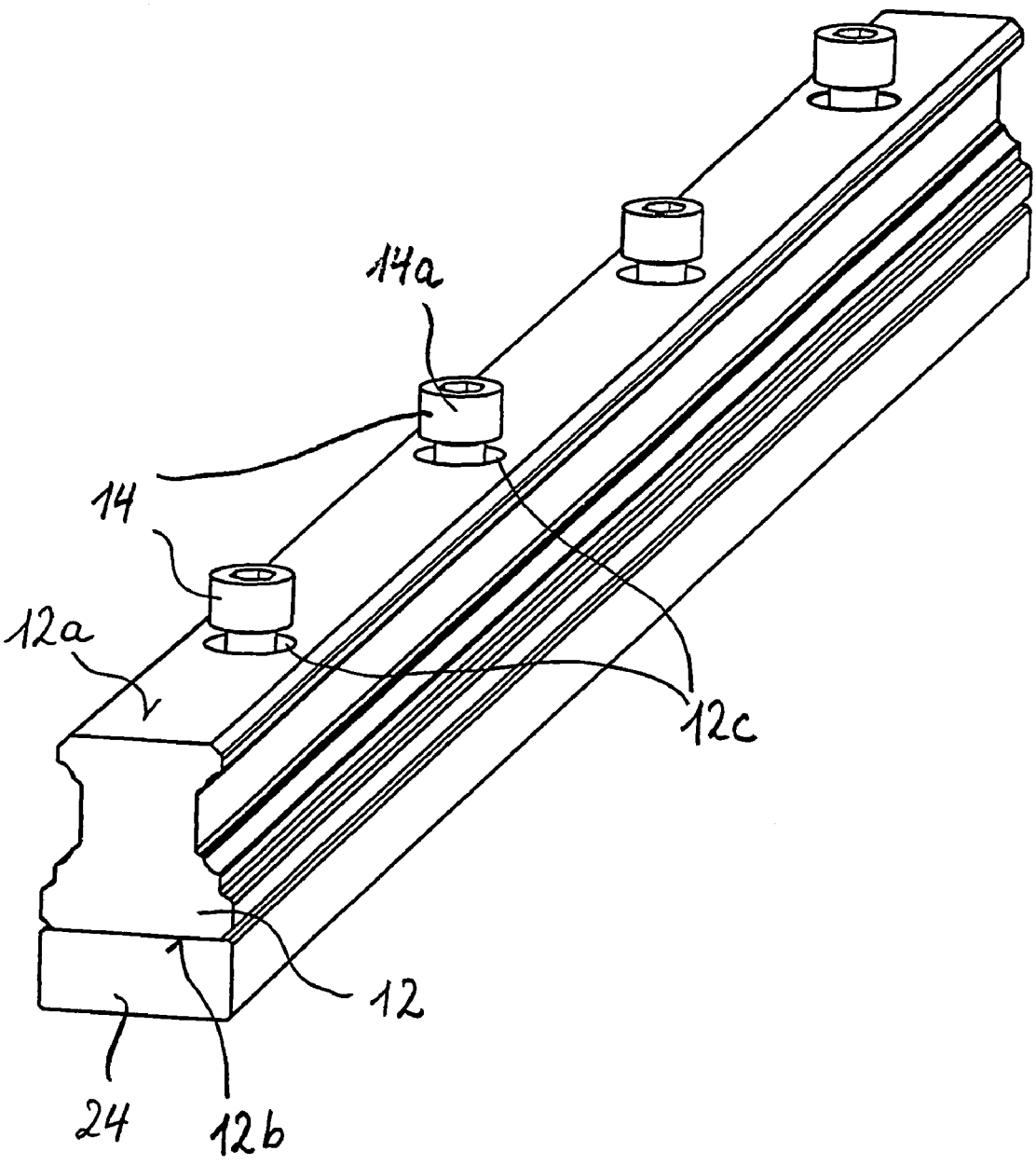
Figure 4:
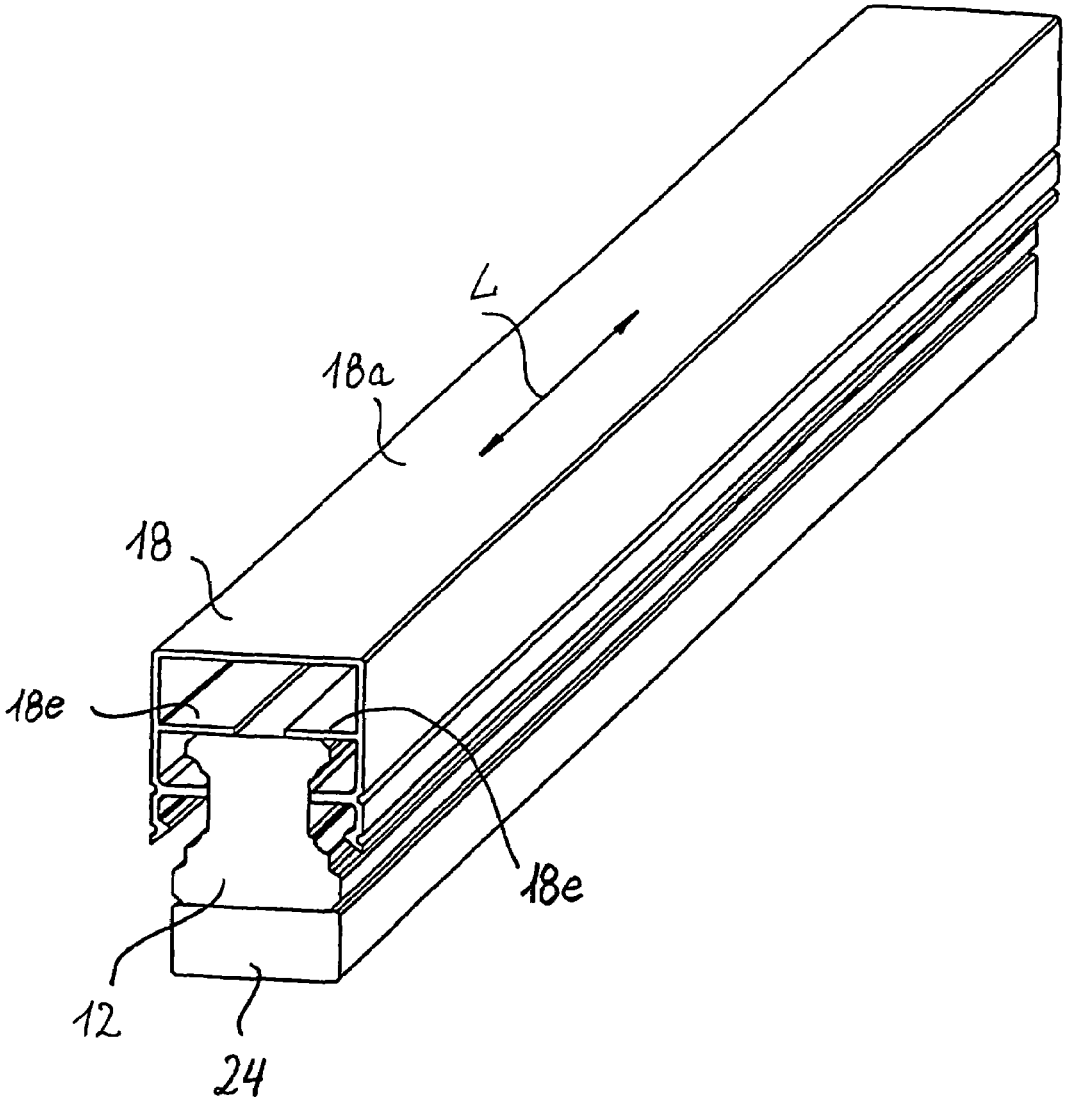

First, as shown in FIG. 3, the profiled rail 12 is attached to a packaging auxiliary rail 24. The auxiliary rail 24 has projections 24*a* at positions corresponding to positions of the through holes 12*c* of the profiled rail 12, as shown in FIG. 2, which engage into the through holes 12*c* with the attached profiled rail 12. In this manner, the projections 24*a* prevent the attachment screws 14 from projecting out over the bottom surface 12*a* upon insertion into the through holes 12*c*. In addition, the projections 24*a* ensure that the heads 14*a* of the attachment screws 14 project out in the packaging-preparation state shown in FIG. 3, as well as over the upper surface of the profiled rail 12, such that they can be engaged under by the locking bars 18*e* of the cover part 18.

After the attachment screws 14 are inserted into the through holes 12*c*, the cover part 18 can be displaced in the longitudinal direction L onto the profiled rail 12 (FIG. 4), so that the heads 14*a* of the attachment screws 14 are accommodated in a form-locking, or positive-locking, manner between the upper wall 18*a* and the locking bars 18*e* of the cover part 18. Subsequently, the pre-packaged profiled rain 12 is removed from the auxiliary rail 24 and the floor part 20 of the packaging 10 is added and locked into the cover part 18 (see FIG. 1). Finally, the front-sided openings of the packaging main body 16 are closed by means of end caps 26 (see FIG. 5).

The unit contained in this manner can then be shrink-wrapped still in plastic film, if desired. However, it is also contemplated that the locking 18*c*/20 and/or the connection of the end caps 26 with the cover part 18 and the floor part 20 is secured merely by adhesive strips.

It will be understood that each of the elements described above, or two or more together, may also find a useful application in other types of constructions differing from the types described above.

While the invention has been illustrated and described herein as a rail packaging and method of packaging, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A packaging for a component, comprising:

at least one attachment element, wherein the component may be attached by means of the at least one attachment element to a mounting surface of a superordinate unit, wherein the component has an upper surface, a bottom surface, and at least one mounting for the at least one attachment element continuing from the upper surface to the bottom surface, wherein the packaging is formed at least partially substantially rigidly and wherein the at least one attachment element inserted in the at least one mounting is held in a form-locking manner in a position, such that the at least one attachment element does not project over the bottom surface of the component, further comprising at least one locking bar, wherein said at least one locking bar engages under a head of the at least one attachment element, wherein a main body of the packaging is composed of at least two parts, a cover part and a floor part, and wherein the at least one locking bar is disposed on the cover part.

2. The packaging according to claim 1, wherein the cover part covers the upper surface and at least a part of lateral surfaces of the component.

3. The packaging according to claim 1, wherein the floor part covers the bottom surface and at least one part of the lateral surfaces of component.

4. The packaging according to claim 1, wherein the cover part has a hole at a position corresponding to the position of the at least one attachment element.

5. The packaging according to claim 1, wherein the at least one locking bar is resiliently disposed on the cover part.

6. The packaging according to claim 1, wherein on a holding bar-free longitudinal end of the cover part, an open mounting is formed in a longitudinal direction of the cover part.

7. The packaging according to claim 1, wherein the cover part and/or the floor part has at least one stabilizing bar, wherein said stabilizing bar is supported on a lateral surface of the component.

8. The packaging according to claim 1, wherein the cover part and/or the floor part is formed as an extruded plastic profile element.

9. The packaging according to claim 1, wherein the cover part and/or the floor part is composed of a plurality of identical components.

10. The packaging according to claim 1, further comprising at least one end cap, wherein the end cap covers an associated front face of the component.

11. The packaging according to claim 10, wherein the end cap and/or the cover part and/or the floor part is made as an injection molded part.

12. The packaging according to claim 1, further comprising means for protecting the component from corrosion.

* * * * *